US006737621B2

(12) United States Patent
Lee

(10) Patent No.: US 6,737,621 B2
(45) Date of Patent: May 18, 2004

(54) MICROWAVE OVEN AND HIGH VOLTAGE CONTROL CIRCUIT OF THE SAME

(75) Inventor: Chea-How Lee, Suwon (KR)

(73) Assignee: Samsung Electronics Co., LTD, Suwon-si (KR)

( * ) Notice: Subject to any disclaimer, the term of this patent is extended or adjusted under 35 U.S.C. 154(b) by 0 days.

(21) Appl. No.: 10/279,886

(22) Filed: Oct. 25, 2002

(65) Prior Publication Data

US 2004/0004076 A1 Jan. 8, 2004

(30) Foreign Application Priority Data

Jul. 2, 2002 (KR) ..... 10-2002-0037793

(51) Int. Cl.[7] ..... H05B 6/68

(52) U.S. Cl. ..... 219/716; 219/702; 219/760; 219/710; 361/103

(58) Field of Search ..... 219/760, 702, 219/715, 716, 710; 361/103, 37; 323/340, 341

(56) References Cited

U.S. PATENT DOCUMENTS 4,620,078 A * 10/1986 Smith ..... 219/760
5,625,520 A 4/1997 Lim ..... 361/103
5,973,304 A * 10/1999 Kim ..... 219/702
6,025,582 A * 2/2000 Kang et al. ..... 219/718

FOREIGN PATENT DOCUMENTS

JP 2-239589 * 9/1990

* cited by examiner

*Primary Examiner*—Philip H. Leung
(74) *Attorney, Agent, or Firm*—Staas & Halsey LLP

(57) ABSTRACT

A microwave oven having a high voltage control circuit which prevents an overheating of a high voltage transformer. The high voltage control circuit includes a thermostat which is turned on or off according to a temperature of the high voltage transformer. The thermostat is disposed between a first fixed terminal of a tap formed at a primary coil of the high voltage transformer and a second fixed terminal connected to a power stage, so as to allow the primary coil to have different numbers of turns. According, where the output of a magnetron of the microwave oven becomes high and the temperature of the high voltage transformer reaches a predetermined temperature, the thermostat is turned off, thus enabling the first and second fixed terminals to be disconnected from each other. Therefore, the number of turns of the primary coil of the high voltage transformer is increased and the voltage supplied to the magnetron is decreased, thus maintaining the decreased output of the magnetron and preventing the overheating of the high voltage transformer.

19 Claims, 2 Drawing Sheets

MICROWAVE OVEN AND HIGH VOLTAGE CONTROL CIRCUIT OF THE SAME

CROSS-REFERENCE TO RELATED APPLICATIONS

This application claims the benefit of Korean Patent Application No. 2002-37793 filed on Jul. 2, 2002, in the Korean Industrial Property Office, the disclosure of which is incorporated herein by reference.

BACKGROUND OF THE INVENTION

1. Field of the Invention

The present invention relates to microwave ovens, and more particularly, to a microwave oven having a high voltage control circuit which prevents an overheating of a high voltage transformer.

2. Description of the Related Art

Generally, microwave ovens are cooking devices which oscillate molecular arrangements of food by generating microwaves and irradiating the microwaves to the food. That is, the food is cooked using a heat generated during the oscillation of the molecular arrangements of the food.

FIG. 1 shows a circuit diagram of a high voltage control circuit of a conventional microwave oven.

As shown in FIG. 1, the high voltage control circuit of the conventional microwave oven comprises a main fuse FUSE which is connected to one AC terminal of an input alternating current (AC) power source, a high voltage transformer HVT which boosts an input voltage, a high voltage condenser HVC and a high voltage diode HVD which convert the voltage boosted by the high voltage transformer HVT into a high direct current (DC) voltage, and a magnetron MGT which is driven by a rectified high voltage to generate microwaves.

In such a conventional microwave oven, a maximum current resistible by the main fuse FUSE is set to be a current that can excessively increase the temperature of the high voltage transformer HVT. Therefore, where the maximum current is exceeded, the main fuse FUSE is blown.

However, the conventional microwave oven is problematic in that, where the main fuse FUSE is blown, the supply of a voltage to a primary coil of the high voltage transformer HVT is shut off, thus stopping the magnetron MGT and preventing the microwave oven from operating until the FUSE is changed.

SUMMARY OF THE INVENTION

Accordingly, it is an aspect of the present invention to provide a microwave oven having a high voltage control circuit which decreases a voltage supplied to a magnetron and prevents overheating of a high voltage transformer by increasing a number of turns of a primary coil of the high voltage transformer so as to decrease the output of the magnetron where a temperature of the high voltage transformer reaches a predetermined temperature.

Additional aspects and advantages of the invention will be set forth in part in the description which follows and, in part, will be obvious from the description, or may be learned by practice of the invention.

To achieve the above and other aspects of the present invention there is provided a microwave oven comprising a magnetron to cook food contained in the oven, a voltage converting unit which supplies a predetermined voltage to the magnetron by boosting an input voltage, and an output variable unit which varies an output of the magnetron by varying a voltage supplied to the magnetron according to a temperature of the voltage converting unit.

To achieve the above and other aspects of the present invention, there is further provided a high voltage control circuit of a microwave oven, comprising a high voltage transformer having a primary coil connected to a power stage of the oven and a secondary coil connected to a load stage of the oven, wherein the high voltage transformer boosts a voltage input from the power stage, a magnetron which is connected to the secondary coil of the high voltage transformer and generates microwaves, a tap formed at the primary coil of the high voltage transformer so as to allow the primary coil to have different numbers of coils, and a switching unit disposed between a first fixed terminal of the tap formed at the primary coil and a second fixed terminal connected to the power stage, and is switched to one of on and off according to a temperature of the high voltage transformer.

BRIEF DESCRIPTION OF THE DRAWINGS

These and other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
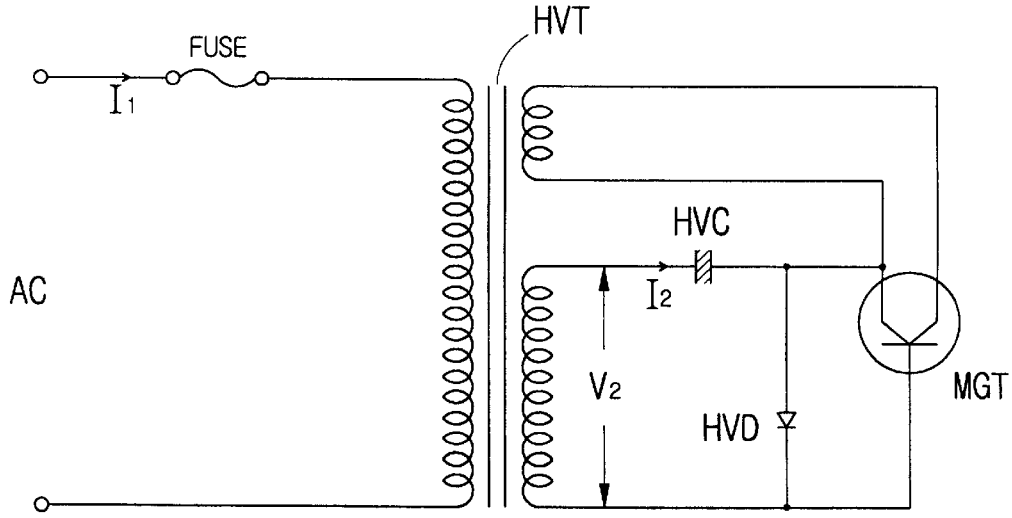
FIG. 1 (PRIOR ART)
FIG. 1 is a diagram of a high voltage control circuit of a conventional microwave oven.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
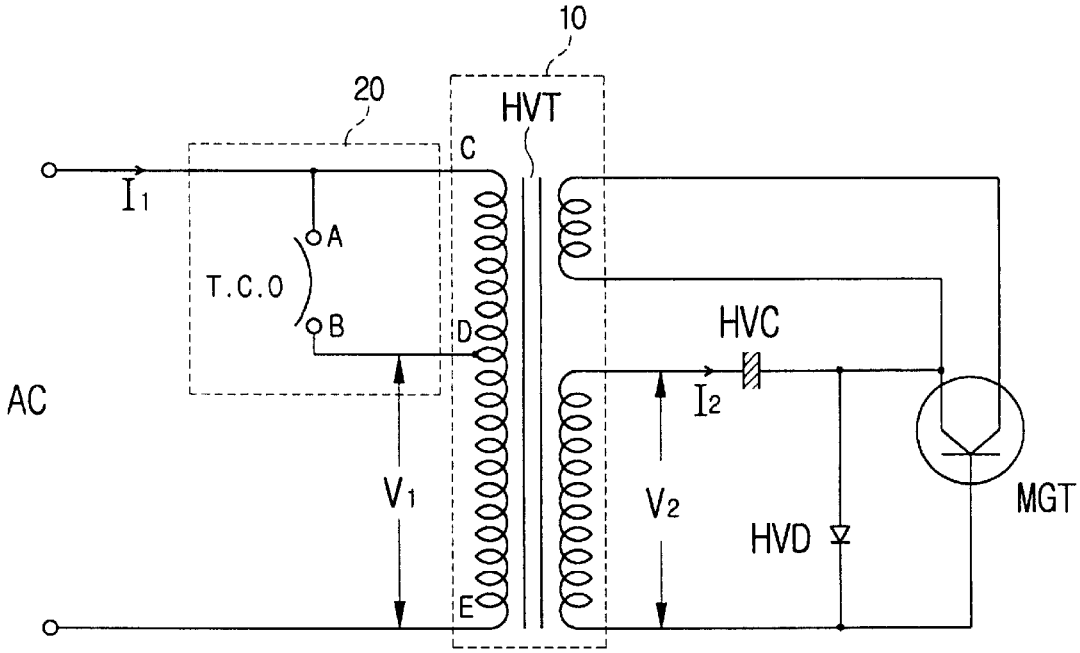
FIG. 2 is a diagram of a high voltage control circuit of a microwave oven according to an embodiment of the present invention.

FIG. 2 shows a high voltage control circuit of a microwave oven according to an embodiment of the present invention. The high voltage control circuit comprises a voltage converting unit 10, an output variable unit 20, a high voltage condenser HVC, a high voltage diode HVD, and a magnetron MGT. The voltage converting unit 10 supplies a predetermined voltage to the magnetron MGT, which generates microwaves, by boosting a voltage inputted from input AC power. The output variable unit 20 varies the output of the magnetron MGT by varying the voltage supplied to the magnetron MGT according to a temperature of the voltage converting unit 10. The high voltage condenser HVC and the high voltage diode HVD convert the voltage boosted by the voltage converting unit 10 into a high DC voltage. The magnetron MGT is driven by a rectified high voltage to generate the microwaves.

The voltage converting unit 10 comprises a high voltage transformer HVT having a primary coil connected to an input power stage and a secondary coil connected to a load stage to supply a voltage to the magnetron MGT. A tap which allows the primary coil to have different numbers of turns is formed at the primary coil, and a fixed terminal B is arranged in the tap. The fixed terminal B is connected to a switching unit, such as a thermostat (T.C.O: temperature cut off), which is arranged in a core of the high voltage transformer HVT and turned on/off according to the temperature of the high voltage transformer HVT.

The thermostat T.C.O is normally turned on to allow the fixed terminals A and B to be shorted, thus enabling a boosted voltage, which is obtained by boosting the input power according to the number of turns of a portion of the primary coil ranging from D to E through the thermostat T.C.O, to be supplied to the magnetron MGT. In such a case, the magnetron MGT provides a normal output.

Where a temperature of the high voltage transformer HVT rises and reaches a preset temperature, the thermostat T.C.O is turned off to allow the fixed terminal A connected to the input power and the fixed terminal B of the tap brought out of the primary coil to be disconnected from each other. Therefore, a boosted voltage (less than the voltage boosted according to the number of turns of the portion of the primary coil ranging from D to E) obtained by boosting the input power according to the number of turns of the primary coil ranging from C to E can be supplied to the magnetron MGT. Accordingly, the magnetron MGT can generate an output relatively lower than the normal output. The increased temperature of the high voltage transformer HVT is gradually decreased by such a lower output.

As described above, the present invention provides a microwave oven having a high voltage control circuit which prevents the overheating of a high voltage transformer. Additionally, the present microwave oven invention can provide a constant output of a magnetron even where a temperature of the high voltage transformer reaches a preset temperature.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A microwave oven, comprising:

a magnetron to cook food contained in the oven;

a voltage converting unit which supplies a predetermined voltage to the magnetron by boosting an input voltage; and an output variable unit which provides a continuous output of the magnetron by varying a voltage supplied to the magnetron according to a temperature of the voltage converting unit.

2. The microwave oven according to claim 1, wherein the output variable unit decreases the voltage supplied to the magnetron in response to the temperature of the voltage converting unit being equal to or greater than a preset temperature, so to allow the magnetron having a preset output level to have an output level of less than the preset output level.

3. The microwave oven according to claim 1, wherein the voltage converting unit comprises:

a primary coil connected to a power stage of the oven; and a secondary coil connected to a load stage of the oven, wherein the voltage converting unit boosts the input voltage input to the primary coil according to a preset boosting ratio and supplies the boosted voltage to the magnetron.

4. The microwave oven according to claim 3, wherein the output variable unit decreases an output voltage of the secondary coil by increasing a number of turns of the primary coil of the voltage converting unit to be greater than a preset number of turns of the primary coil in response to the temperature of the voltage converting unit being equal to or greater than a preset temperature.

5. The microwave oven according to claim 1, further comprising a voltage condenser and a voltage diode which convert the input voltage boosted by the voltage converting unit into a direct current (DC) voltage.

6. The microwave oven according to claim 1, wherein the magnetron generates microwaves to cook the food.

7. The microwave oven according to claim 1, wherein:

the voltage converting unit includes primary and secondary coils, and the output variable unit includes a switch unit which is connected to the primary coil and allows the primary coil to have different numbers of turns according to the temperature of the voltage converting unit.

8. The microwave oven according to claim 7, wherein the output variable unit prevents overheating of the voltage converting unit by increasing the number of turns of the primary coil so as to decrease an output voltage of the secondary coil supplied to the magnetron.

9. A high voltage control circuit of a microwave oven, comprising:

a high voltage transformer having a primary coil connected to a power stage of the oven and a secondary coil connected to a load stage of the oven, wherein the high voltage transformer boosts a voltage input from the power stage;

a magnetron which is connected to the secondary coil of the high voltage transformer and generates microwaves;

a tap formed at the primary coil of the high voltage transformer so as to allow the primary coil to have different numbers of turns; and a switching unit disposed between a first fixed terminal of the tap formed at the primary coil and a second fixed terminal connected to the power stage, and is switched to one of on and off according to a temperature of the high voltage transformer.

10. The high voltage control circuit of a microwave oven according to claim 9, wherein the switching unit is a thermostat which is predisposed to be on to allow the first and second fixed terminals to be shorted, and is switched to be turned off to allow the first and second fixed terminals to be disconnected from each other in response to the temperature of the high voltage transformer being equal to or greater than a preset temperature.

11. The high voltage control circuit of a microwave oven according to claim 9, further comprising a voltage condenser and a voltage diode which are connected to the secondary coil and convert the voltage boosted by the high voltage transformer to a direct current (DC) voltage.

12. The high voltage control circuit of a microwave oven according to claim 9, wherein the switching unit varies an output of the magnetron by varying a voltage supplied to the magnetron according to the temperature of the high voltage transformer.

13. The high voltage control circuit of a microwave oven according to claim 12, wherein the switching unit is open to disconnect the first and second fixed terminals to increase the number of turns of the primary coil, in response to the temperature of the high voltage transformer being equal to or greater than a preset temperature.

14. A microwave oven, comprising:

a magnetron which generates microwaves;

a voltage converting unit which boots and supplies a voltage to the magnetron, wherein the voltage converting unit includes a primary coil; and an output variable unit which varies the voltage supplied to the magnetron by increasing/decreasing a number of turns of the primary coil according to a temperature of the voltage converting unit.

15. The microwave oven according to claim 14, wherein the output variable unit increases the number of turns of the primary coil in response to the temperature being equal to or greater than a preset temperature, so as to decrease an output of the magnetron and prevent overheating of the voltage converting unit.

16. The microwave oven according to claim 14, wherein the output variable unit decreases the number of turns of the primary coil in response to the temperature being less than a preset temperature.

17. A microwave oven, comprising:

a magnetron which generates microwaves;

a voltage converting unit which boots and supplies a voltage to the magnetron, wherein the voltage converting unit includes a primary coil; and an output variable unit which prevents overheating of the voltage converting unit by increasing/decreasing a number of turns of the primary coil according to a temperature of the voltage converting unit.

18. The microwave oven according to claim 17, wherein the output variable unit increases the number of turns of the primary coil in response to the temperature being equal to or greater than a preset temperature.

19. The microwave oven according to claim 17, wherein the output variable unit decreases the number of turns of the primary coil in response to the temperature being less than a preset temperature.

* * * * *

UNITED STATES PATENT AND TRADEMARK OFFICE

CERTIFICATE OF CORRECTION

PATENT NO. : 6,737,621 B2
DATED : May 18, 2004
INVENTOR(S) : Chea-How Lee

It is certified that error appears in the above-identified patent and that said Letters Patent is hereby corrected as shown below:

Column 4,
Line 65, change “boots” to -- boosts --.

Column 6,
Line 1, change “boots” to -- boosts --.

Signed and Sealed this

Thirty-first Day of August, 2004

JON W. DUDAS
*Director of the United States Patent and Trademark Office*

UNITED STATES PATENT AND TRADEMARK OFFICE

CERTIFICATE OF CORRECTION

PATENT NO. : 6,737,621 B2
DATED : May 18, 2004
INVENTOR(S) : Chea-How Lee

It is certified that error appears in the above-identified patent and that said Letters Patent is hereby corrected as shown below:

Column 4,
Line 65, change “boots” to -- boosts --.

Column 6,
Line 1, change “boots” to -- boosts --.

Signed and Sealed this

Seventh Day of September, 2004

JON W. DUDAS
*Director of the United States Patent and Trademark Office*